US005413058A

United States Patent [19]

Hirose et al.

[11] Patent Number: 5,413,058

[45] Date of Patent: May 9, 1995

[54] INNER BOBBIN CASE HOLDER OF A FULLY ROTATING HOOK

[75] Inventors: Tokuzo Hirose, Ashiya; Kiyoshi Nakamura, Matsubara, both of Japan

[73] Assignee: Hirose Manufacturing Co., Ltd., Osaka, Japan

[21] Appl. No.: 131,657

[22] Filed: Oct. 5, 1993

[30] Foreign Application Priority Data

Dec. 9, 1992 [JP] Japan ..... 4-329337
Feb. 19, 1993 [JP] Japan ..... 5-030936

[51] Int. Cl.[6] ..... D05B 57/26
[52] U.S. Cl. ..... 112/231
[58] Field of Search ..... 112/230, 231, 228, 181, 112/184

[56] References Cited

U.S. PATENT DOCUMENTS 4,393,798 7/1983 Cheng ..... 112/231
4,638,750 1/1987 Mikuni .
4,700,643 10/1987 Hirose et al. ..... 112/231
4,858,543 8/1989 Badillo ..... 112/231
5,188,046 2/1993 Badillo ..... 112/231

FOREIGN PATENT DOCUMENTS 60-64777 5/1985 Japan .

*Primary Examiner*—Clifford D. Crowder
*Assistant Examiner*—Paul C. Lewis
*Attorney, Agent, or Firm*—Wenderoth, Lind & Ponack

[57] ABSTRACT

A bobbin case holder body and a track projection portion are made of steel. A coating member of a liquid crystal polymer is integrally molded to the outer surface of the track projection portion so as to have a thickness t which is selected to be 0.3 to 0.5 mm. A part of the coating member is fitted into a groove formed in the track projection portion, thereby preventing the member from peeling off. In a loop spreading portion, the track projection portion made of steel is exposed from the coating member so that a so-called thread handing area is prevented from being formed. Therefore, wear resistance and durability are improved.

18 Claims, 8 Drawing Sheets

INNER BOBBIN CASE HOLDER OF A FULLY ROTATING HOOK

BACKGROUND OF THE INVENTION

1. Field of the Invention

The present invention relates to an inner bobbin case holder (hereinafter, often referred to merely as "bobbin case holder") of a fully rotating hook provided in a lockstitch sewing machine or the like, and particularly to the configuration of a track projection thereof.

2. Description of the Related Art

In a bobbin case holder provided in a lockstitch sewing machine or the like, a track projection is formed on an outer surface of the holder, and the track projection is fitted into a track groove formed on an inner surface of an outer loop taker. Only the outer loop taker is rotated at a high speed, while rotation of the bobbin case holder in the downstream direction of the rotation of the outer loop taker is blocked by a rotation restraining member fixed to the body of the sewing machine. Particularly, an outer loop taker for an industrial sewing machine is rotated at a high speed of about 6,000 to 10,000 rpm. Therefore, the sliding contact between the track projection and the track groove generates a large friction force. This necessitates a large torque for rotating the outer loop taker. When the friction between the track projection and the track groove is large, the rotation restraining member blocking the rotation of the bobbin case holder is pressed with a large force by an inner surface of the bobbin case holder into which the rotation restraining member is fitted, thereby impeding smooth loop-spreading of a needle thread. This causes the tension of the needle thread to be unwillingly changed, producing problems in that sewing quality is impaired and that the track projection and the track groove are worn so that durability thereof is lowered. A well known countermeasure to solve these problems is to utilize a configuration in which a lubricant is supplied to the interface between the track projection of the bobbin case holder and the track groove of the outer loop taker. However, this countermeasure has a drawback that needle and bobbin threads and cloth may be stained by the lubricant.

Conventionally therefore, the track projection of the bobbin case holder is coated by a material such as a fluororesin which has a low friction coefficient, or shaped using only a heat resistant and wear resistant resin. As disclosed in Japanese patent publication (Kokai) No. SHO60-64,777, a heat resistant and wear resistant resin may be detachably attached to the track projection of the bobbin case holder.

In the prior art, when fluororesin or the like is to be coated on the bobbin case holder, the resin is sprayed on the holder and then baked. Since the film thickness is generally as thin as about 10 to 20 $\mu$m, the durability of the film is low, thereby producing a problem in that the resin film is easily peeled off. When a bobbin case holder is shaped by using only a heat resistant and wear resistant resin, the portion over which a thread passes is worn to a larger degree compared with other portions of the holder so that a so-called thread handing area is formed, thereby producing a problem in that the bobbin case holder is inferior in durability to a holder made of steel. Furthermore, in the ease that a synthetic resin is detachably fitted, the synthetic resin is liable to slip off during operations or causes a trouble such as that a thread is caught in a gap between the synthetic resin and the track projection portion.

It is an object of the invention to provide a bobbin case holder of a fully rotating hook wherein friction between sliding portions of the bobbin case holder and an outer loop taker is reduced as much as possible so that the outer loop taker can rotate smoothly and stably at a high speed.

In a rotating hook for a sewing machine, the track projection of the bobbin case holder is fitted into the track groove of the outer loop taker, and the outer loop taker rotates at a high speed, whereby the sewing operation is performed. It is intended to reduce the friction coefficient between the track projection and the track groove to reduce the torque necessary for rotating the outer loop taker, so that sewing quality can be improved.

It is another object of the invention to provide a bobbin case holder of a sewing machine wherein the friction coefficient between the track projection of the bobbin case holder and the track groove of an outer loop taker is reduced so that the outer loop taker can rotate with a small torque.

SUMMARY OF THE INVENTION

The bobbin case holder for a full rotary hook of the invention comprises a track projection formed by integrating a coating member made of a synthetic resin with a track projection portion of the bobbin case holder body made of a metal, which portion extends from a loop spreading portion to a thread releasing portion, and the track projection portion made of metal is exposed from the coating member upstream relative to the direction of rotation of an outer loop taker, in the loop spreading portion.

In a preferred embodiment, the coating member is made of a liquid crystal polymer.

According to the invention, a track projection portion of the bobbin case holder body made of a metal is formed to extend from a loop spreading portion of the track projection portion to a thread releasing portion thereof. A coating member made, for example, of a synthetic resin is outwardly integrated to the track projection portion. The coating member can be strongly integrated with the track projection portion so that the coating member is prevented from being easily peeled off from the track projection portion. Therefore, the friction between the track projection of the bobbin case holder and the track groove of the outer loop taker is reduced so that the outer loop taker can rotate smoothly and stably at a high speed. This eliminates the necessity of supplying a lubricant to the track projection and the track groove, thereby preventing threads and cloth from being stained by lubricant. In the loop spreading portion over which a thread slidingly passes, since the track projection portion made of a metal is exposed from the coating member upstream relative to the rotation direction of rotation of the outer loop taker, a so-called thread handing area is prevented from being formed.

Since the coating member is made of a liquid crystal polymer, friction between the sliding portions is reduced so that wear resistance is further improved. This reduces abrasion wear of the coating member so that durability of the bobbin case holder can be improved.

As described above, according to the invention, a track projection portion of the bobbin case holder body made of a metal, which portion extends from a loop spreading portion to a thread releasing portion, is integrated with a coating member made of a synthetic resin to form a track projection, and, in the loop spreading portion over which a thread passes, the track projection portion made of a metal is exposed from the coating member upstream relative to the direction of rotation of an outer loop taker. Accordingly, wear resistance can be improved, and a thread handing area is prevented from being formed so that durability of the portion is improved.

According to the invention, moreover, since the coating member is made of a liquid crystal polymer, the durability and the wear resistance can be further improved.

The invention further is directed an inner bobbin case holder for a sewing machine which is characterized in that a track projection made of a synthetic resin or an inorganic material is fixed to the outer periphery of the body of the bobbin case holder.

Moreover, the invention characterized in that it may be employed with a horizontal axis full rotary hook, a vertical axis full rotary hook and a oscillating loop taker.

Moreover, the invention is characterized in that at least the surface layer of the track projection portion is made of high-density polyethylene including a lubricant.

Moreover, the invention is an inner bobbin case holder for a sewing machine which is characterized in that the track projection is made of a liquid crystal polymer.

Moreover, the invention is characterized in that the track projection is made of a material in which alumina powder is scattered in aluminum alloy powder.

Moreover, the invention is characterized in that the track projection is made of a material in which metal powder is scattered in fluororesin (for example, polytetrafluoroethylene (abbreviated as PTFE), Teflon, etc.).

According to the invention, a track projection made of a synthetic resin or an inorganic material is fixed to the outer periphery of the body of the bobbin case holder, whereby the friction coefficient between the track projection and a track groove of an outer loop taker is reduced so that the torque required for rotating the outer loop taker is reduced. This enables the outer loop taker to rotate smoothly and stably at a high speed, thereby improving sewing quality.

The track projection may be fitted into the body of the bobbin case holder and fixed thereto by its resilient force. Alternatively, the track projection may be fixed to the body of the bobbin case holder by an adhesive. In this way, the track projection is detachably mounted. When the track projection becomes worn, therefore, it can be replaced with a new track projection. This enables the body of the bobbin case holder to be used for a long period of time.

As described above, according to the invention, a track projection made of a synthetic resin or an inorganic material is fixed to the outer periphery of the body of the bobbin case holder and fitted into a track groove of an outer loop taker, whereby the friction coefficient between the track projection and the track groove is reduced so that the torque required for rotating the outer loop taker is reduced. This enables the outer loop taker to rotate smoothly and stably at a high speed, thereby improving sewing quality.

BRIEF DESCRIPTION OF THE DRAWINGS

Other and further objects, features, and advantages of the invention will be more made explicit from the following detailed description taken with reference to the drawings wherein.

DETAILED DESCRIPTION OF THE INVENTION

Figure 1:
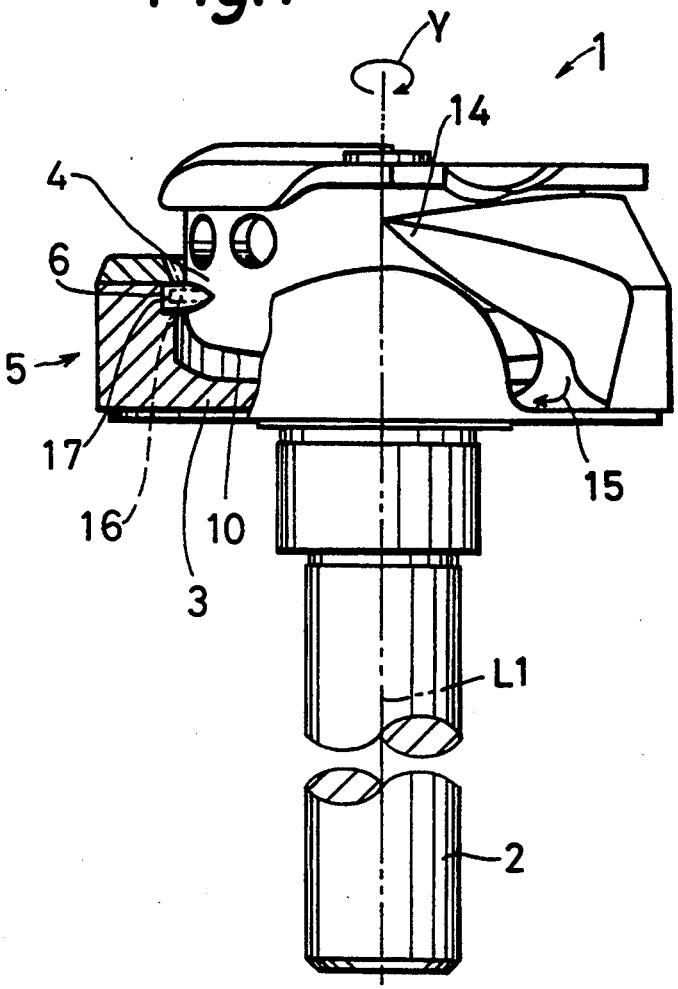
FIG. 1 is a partial cutaway front view of a vertical axis full rotary hook including an embodiment of the invention.

Referring now to the drawings, preferred embodiments of the invention are described below.

Figure 2:
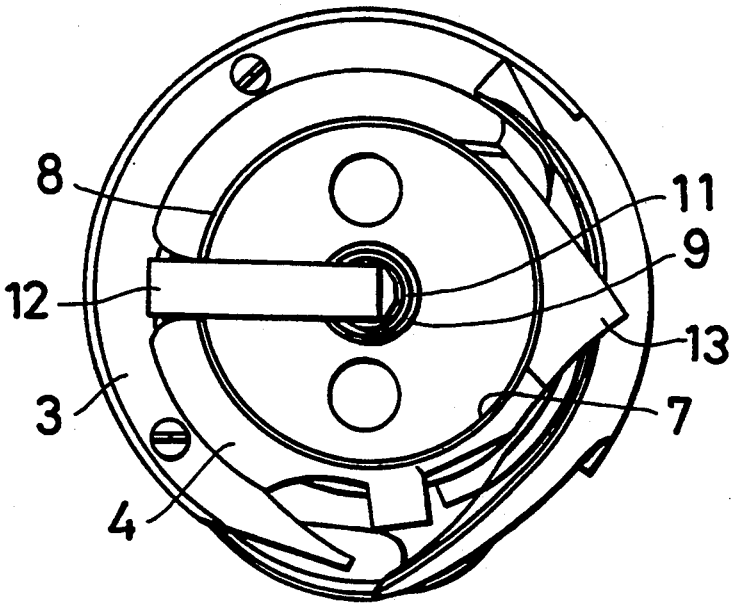
FIG. 2 is a plan view thereof.

FIG. 1 is a partial cutaway front view of a vertical axis fully rotary hook 1 including an embodiment of the invention, and FIG. 2 is a plan view of the vertical axis fully rotary hook 1. A bobbin case holder 4 is installed in an outer loop taker 3 having a rotation shaft 2. A track projection 5 formed on the outer surface of the bobbin case holder 4 is fitted into a track groove 6 formed on the inner surface of the outer loop taker 3. A bobbin 8 on which a bobbin thread is wound is housed in a recess 7 of the bobbin case holder 4. Through a center hole 9 of the bobbin 8 is inserted a cylindrical stud 11 which protrudes from a bottom 10 of the bobbin case holder 4 toward the open end thereof. A pressing piece 12 is swingably attached to the end of the stud 11 in such a manner that the pressing piece 12 can be stably situated in either of a state in which it is elongated in the shaft direction and a state in which it is directed in a radial direction. When the pressing piece 12 is swung as shown in FIG. 2 to enter such stable state directed in the radial direction of the bobbin case holder 4 while the bobbin 8 is housed in the recess 7 of the bobbin case holder 4, the bobbin 8 in the recess 7 is prevented from slipping off. When the pressing piece 12 is erected in the longitudinal direction of the stud 11, the bobbin 8 can be removed from the bobbin case holder 4.

The bobbin case holder 4 is provided with a butting member 13 which protrudes outwardly in the radial direction. A rotation restraining member which is not shown butts the butting member 13 to block rotation of the bobbin case holder 4 along with the rotation of the outer loop taker 3. Under this state, the outer loop taker 3 is rotated about a rotation axis L1. The outer loop taker 3 is provided with a loop seizing beak 14. The needle thread seized by the loop seizing beak 14 is carried in the direction indicated by arrow 15 so as to pass along the outer surface of the bobbin case holder 4, and then is engaged with a bobbin thread picked up from the bobbin 8 to continuously form stitches on a workpiece.

Figure 3:
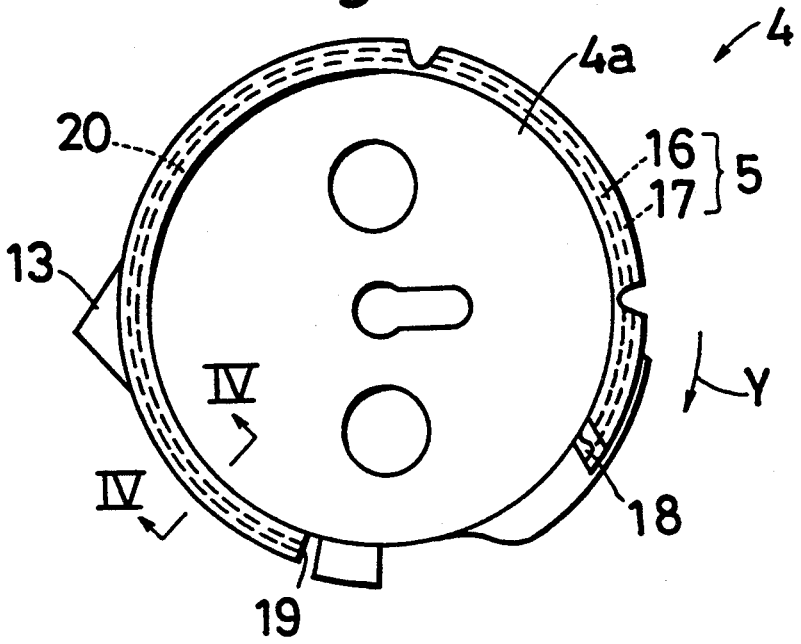
FIG. 3 is a rear view of a bobbin case holder thereof.

FIG. 3 is a rear view of the bobbin case holder 4 of the vertical axis full rotary hook 1. The bobbin case holder 4 comprises as basic components a body 4*a*, and the track projection 5 formed on the outer surface of the bobbin case holder body 4*a*. The track projection 5 has a loop spreading portion 18 and a thread releasing portion 19 formed in such a manner that they are separated from each other in the circumferential direction of holder 4. The track projection 5 consists of a track projection portion 16 and a coating member 17. At the loop spreading portion 18, the track projection portion 16 is exposed from the coating member 17 upstream relative to a direction of rotation Y of the outer loop taker 3. A groove 20 is formed in the track projection portion 16. A part of the coating member 17 is fitted into the groove 20.

Figure 4:
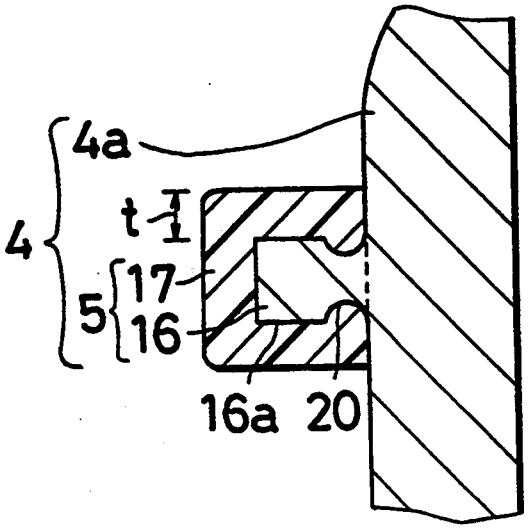
FIG. 4 is an enlarged sectional view taken on line IV—IV of FIG. 3.

FIG. 4 is an enlarged sectional view taken on line IV—IV of FIG. 3. The bobbin case holder body 4*a* and the track projection portion 16 are made of steel. The coating member 17 consists of a liquid crystal polymer add is integrally molded, for example, to an outer surface 16*a* of the track projection portion 16 so as to have a thickness t which is selected to be 0.3 to 0.5 mm. The formation of the coating member 17 having such a sufficient thickness improves durability. Since a part of the coating member 17 is fitted into the groove 20 formed on the track projection portion 16, the coating member 17 is prevented from slipping off from the track projection portion 16.

The liquid crystal polymer used in the coating member 17 will be described in detail. In a liquid crystal polymer having rod-like stiff components in principal chains of polymers, there exist large inter-molecular forces between the stiff chain components, and crystallization with excellent orientation is obtained upon a shaping. Accordingly, the liquid crystal polymer is very excellent in heat resistance so that, even when the temperature is raised by friction caused by the outer loop taker 3 rotating at a high speed, a very high thermal deformation temperature prevents deformation from occurring. The liquid crystal polymer has excellent strength and has a high elastic modulus because it consists of stiff molecular chains and is highly oriented in flowing direction upon the shaping. Moreover, since molecular chains are arranged to extend to their full length in the orientation direction, the liquid crystal polymer exhibits excellent creep characteristics in which the molecular chains do not lengthen further even when a tensile force is applied. The linear expansion coefficient of the liquid crystal polymer is very small. Particularly, the linear expansion coefficient in the flowing direction is as small as about $1\times10^{-5}$ cm/cm/°C. This linear expansion coefficient, which is smaller by one figure than those of other synthetic resins, enables the liquid crystal polymer to have a dimensional stability of the same degree as that of a metal, with the result that there occurs substantially no dimensional change due to differences in ambient temperature and humidity, such as environment differences between seasons. Moreover, the liquid crystal polymer has excellent weatherability so that it can be used for a long period of time. Since the structure of the liquid crystal polymer in the molten state is similar to that in the solidified state, phase changes are small in degree, and also the volume change upon solidifying is small.

The liquid crystal polymer has a very interesting property of damping vibration. Although a soft material such as rubber generally has an excellent vibration damping property, the liquid crystal polymer has an excellent vibration damping property while it has a high elastic modulus. In order to improve wear resistance, the liquid crystal polymer may be mixed with 30% of carbon fibers, thereby reducing abrasion wear and the coefficient of dynamic friction.

Even when a sewing operation is performed at a high speed and for a long period of time while using the bobbin case holder 4 in which the track projection 5 having the coating member 17 made of such a liquid crystal polymer is formed, the abrasion wear of the surface of the track projection 5 is reduced to a very low level. Since, in the loop spreading portion 18 over which a thread passes, the track projection portion 16 made of steel is exposed from the coating member 17, the formation of a so-called thread handing area is prevented from occurring.

Figure 5:
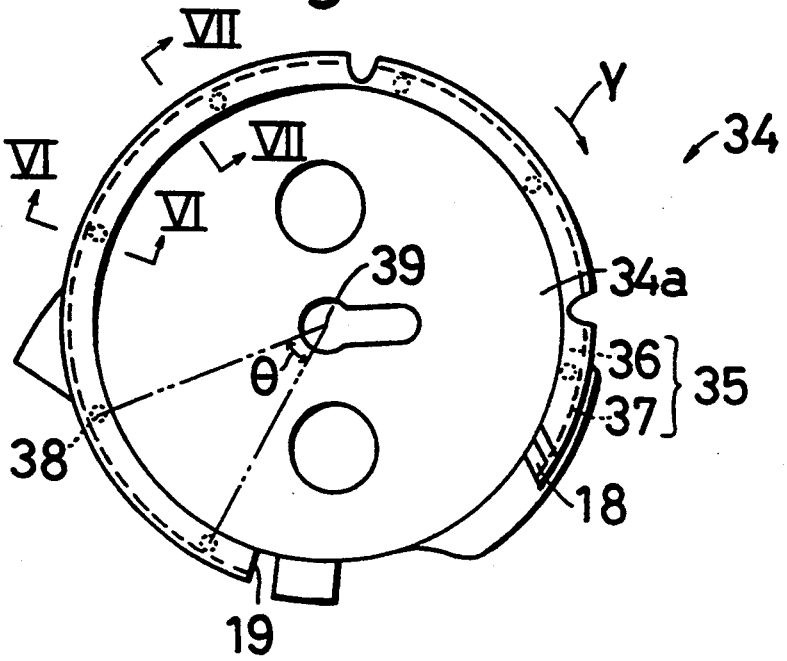
FIG. 5 is a rear view of a bobbin case holder according to another embodiment of the invention.

FIG. 5 is a rear view of a bobbin case holder 34 according to another embodiment of the invention. The bobbin case holder 34 comprises as basic components a body 34*a*, and a track projection 35 formed on the outer surface of the bobbin case holder body 34*a*. The track projection 35 includes a loop spreading portion 18 and a thread releasing portion 19 formed in such a manner that they are separated circumferentially from each other. The track projection 35 includes a track projection portion 36 and a coating member 37. In the loop spreading portion 18, the track projection portion 36 is exposed from the coating member 37 side upstream side relative to the direction of rotation Y of the outer loop taker 3. In the track projection portion 36 are formed five or six small holes 38 of a diameter of about 1.0 mm in such a manner that they are spaced in the circumferential direction by an angle $\theta$ of about 50 deg. as viewed from a center 39 of the bobbin case holder 34. The liquid crystal polymer material of coating member 37 is filled also into the small holes 38.

Figure 6:
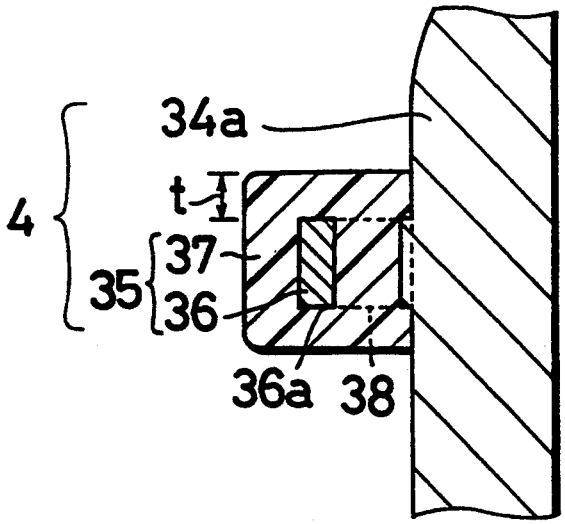
FIG. 6 is an enlarged sectional view taken on line VI—VI of FIG. 5.
Figure 7:
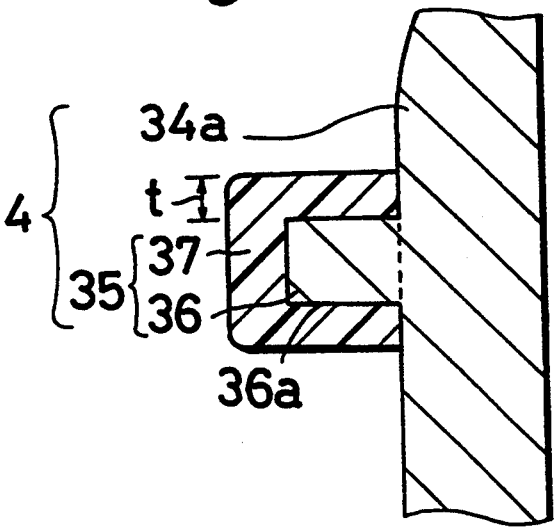
FIG. 7 is an enlarged sectional view taken on line VII—VII of FIG. 5.

FIG. 6 is an enlarged sectional view taken on line VI—VI of FIG. 5, and FIG. 7 is an enlarged sectional view taken on line VII—VII of FIG. 5. The bobbin case holder body 34*a* and the track projection portion 36 having the small holes 38 are made of steel. The coating member 37 consists of a liquid crystal polymer and is integrally molded to an outer surface 36*a* of the track projection portion 36 so as to have a thickness t which is selected to be 0.3 to 0.5 mm. A part of the liquid crystal polymer enters the small holes 38 so as to fill them. In the areas where the small holes 38 are not formed, as shown in FIG. 7, the track projection 35 consists of the coating member 37 of the thickness t and the track projection portion 36. By the configuration in which the small holes 38 are formed in the track projection portion 36 and the small holes 38 are filled with a liquid crystal polymer, the coating member 17 is further prevented from slipping off.

Figure 8:
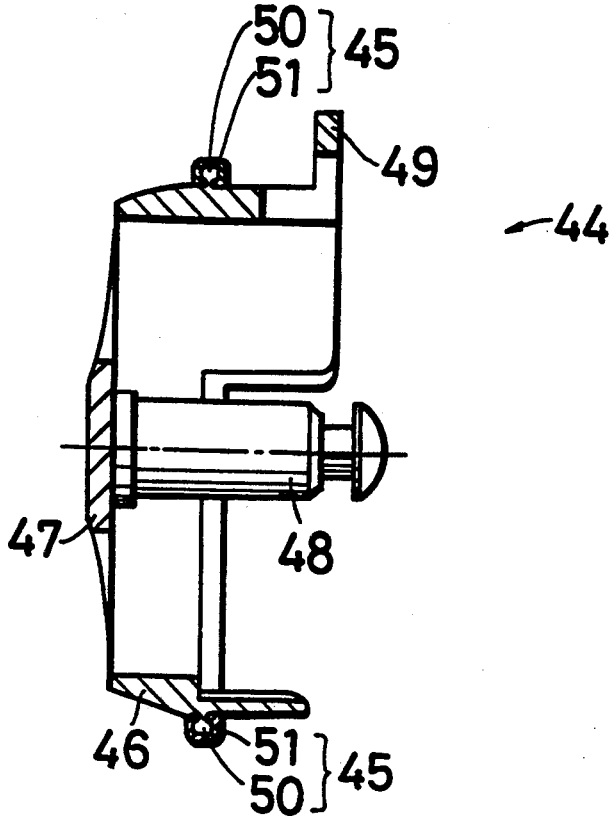
FIG. 8 is a sectional view of a bobbin case holder of a horizontal axis full rotary hook according to a further embodiment of the invention.

FIG. 8 is a sectional view of a bobbin case holder 44 of a horizontal axis full rotary hook according to a further embodiment of the invention. The bobbin case holder 44 comprises a cylinder portion 46 having an outer surface on which a track projection 45 is formed, a bridge 47 which is formed at one end of the cylinder portion 46 and is continuous with such end in a direction normal to the axial direction of portion 46, and a stud 48 which protrudes from the bridge 47 toward the open end of the bobbin case holder 44. A flange 49 extending outwardly in the radial direction is formed at an end portion of the open end of portion 46 of the bobbin case holder 44. The track projection 45 consists of a track projection portion 50 and a coating member 51, and has the same configuration as that of FIG. 4.

Figure 9:
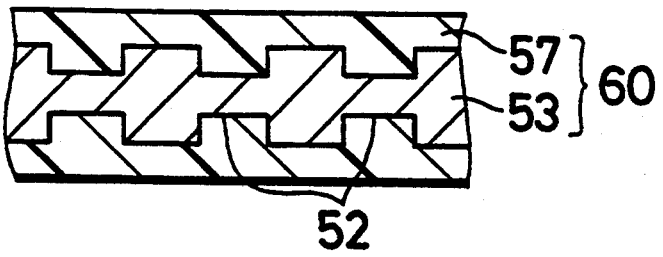
FIG. 9 is a sectional view developed in a circumferential direction of a still further embodiment of the invention.

In a still further embodiment of the invention, as shown in the sectional view of FIG. 9 which is developed in the circumferential direction, column-like or cubic recesses 52 may be formed at spaced intervals in the longitudinal direction of a track projection portion 53. Each of the recesses 52 is filled with a coating member 57 made of a liquid crystal polymer, so that a track projection 60 which is prevented from slipping off is formed on the bobbin case holder body.

Figure 10:
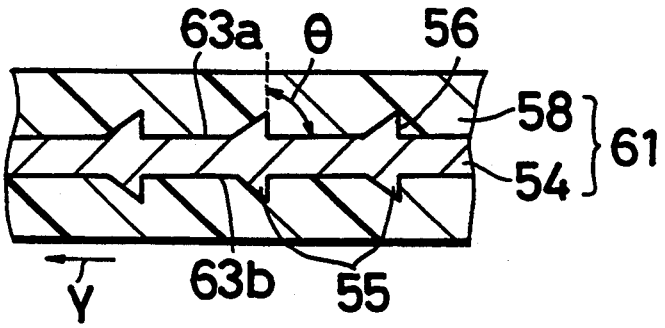
FIG. 10 is a sectional view developed in a circumferential direction of a still further embodiment of the invention.

In a still further embodiment of the invention, as shown in the sectional view of FIG. 10 which is developed in the circumferential direction, a plurality of projections 55 may be formed at equal spaced intervals in the longitudinal direction of a track projection portion 54. Each of the projections 55 projects in directions (upward and downward directions in FIG. 10) of the thickness of the track projection portion 54, while the degree of projection increases upstream (toward the right in FIG. 10) relative to the direction of rotation Y of the outer loop taker. A coating member 58 is made of a liquid crystal polymer. Each of upstream end faces 56 of the projections 55, relative to the direction of rotation Y, forms an angle $\theta$ with respect to side faces 63*a* and 63*b* of the track projection portion 54 that are parallel to each other. The angle $\theta$ is adequately selected within a range of, for example, 45 to 90 deg.

Figure 11:
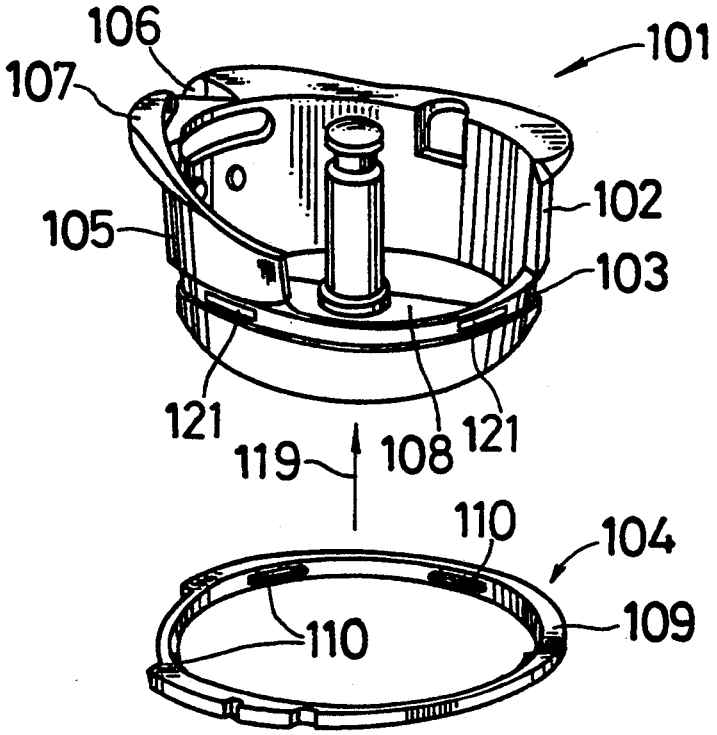
FIG. 11 is an exploded perspective view of a bobbin case holder according to a still further embodiment of the invention.

FIG. 11 is a perspective view of a bobbin case holder 101, used in a horizontal axis full rotary hook, according to a still further embodiment of the invention. The bobbin case holder 101 comprises as basic components a body 102, and a track projection member 104 which is fitted into and fixed to a fitting groove 103 formed on the outer periphery of the bobbin case holder body 102. The bobbin case holder body 102 comprises a cylinder 105, a flange 107 which is formed at an end of the cylinder 105 and has a rotation restraining notch 106, and a bottom 108 formed at the other end of the cylinder 105.

Figure 12:
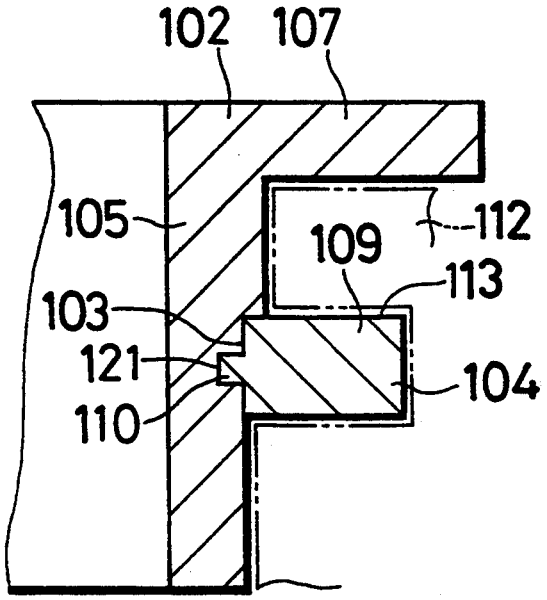
FIG. 12 is a sectional view showing the vicinity of a fitting groove thereof.

FIG. 12 is a sectional view showing the vicinity of the fitting groove 103. The track projection member 104 is fitted into the fitting groove 103, and comprises a track projection 109, and a plurality of fitting projections 110 which project inwardly in the radial direction. The fitting projections 110 are formed at spaced intervals in the circumferential direction so as to be integrated with the track projection 109. The track projection 109 is fitted into a track groove 113 of an outer loop taker 112 which will be described later. The outer loop taker 112 is rotated at a high speed.

Figure 13:
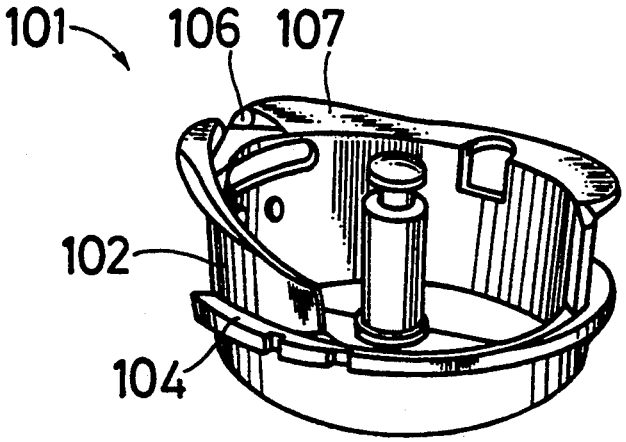
FIG. 13 is a perspective view of a bobbin case holder according to a still further embodiment of the invention.
Figure 14:
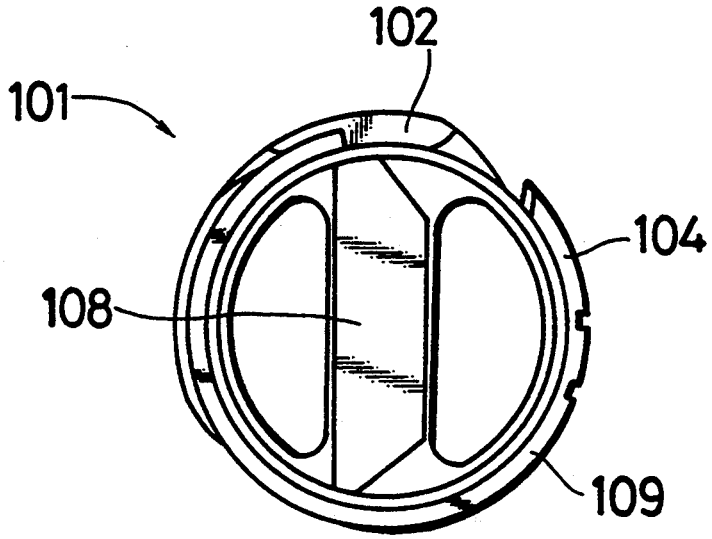
FIG. 14 is a bottom view thereof.
Figure 15:
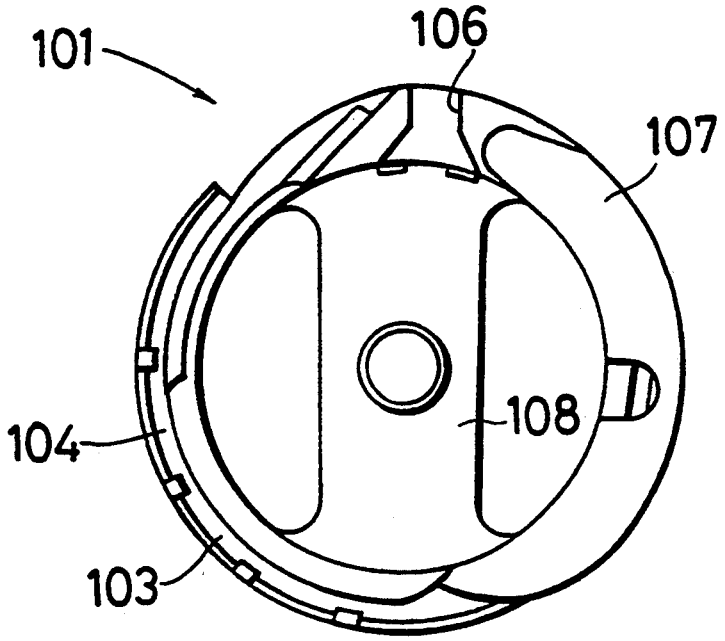
FIG. 15 is a plan view thereof.
Figure 16:
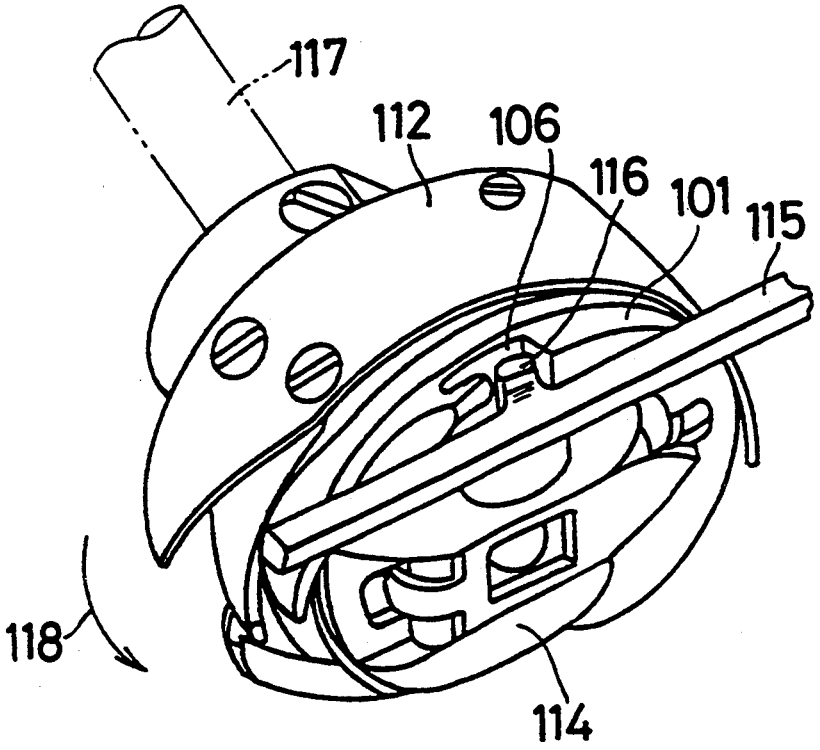
FIG. 16 is a perspective view of a horizontal axis full rotary hook including the holder thereof.

FIG. 13 is a perspective view of the bobbin case holder 101 which has been assembled. The track projection member 104 is fittingly fixed to the bobbin case holder body 102. The bobbin case holder 101 has a configuration which is shown in the bottom view of FIG. 14 and the plan view of FIG. 15. The thus configured bobbin case holder 101 is installed in the outer loop taker 112 as shown in FIG. 16 and a bobbin case 114 is housed in the bobbin case holder 101. A rotation restraining projection 116 fixed to a body 115 of a sewing machine is fitted into a rotation restraining recess 106 of the bobbin case holder 101, so that, when the outer loop taker 112 is rotated as indicated by arrow 118, the rotation of the bobbin case holder 101 is blocked. A rotation shaft 117 of the outer loop taker 112 defines a horizontal axis.

The track projection member 104 is made of a material such as a synthetic resin or an inorganic material. The endless ring-like track projection 109 thus is resilient. This resilience allows the track projection 109 of the track projection member 104 to be pressed to the bottom 108 of the bobbin case holder body 102 as shown by reference numeral 119 in FIG. 11, so as to be fitted thereinto. At this time, the fitting projections 110 are tightly and resiliently fitted into mounting recesses 121 which are formed in the fitting groove 103 of the bobbin case holder body 102 and which are elongated in the circumferential direction. In this way, the track projection 109 is detachably fixed to the bobbin case holder body 102. The shape of the inner surfaces of the mounting recesses 121 is substantially the same as that of the outer surfaces of the fitting projections 110, so that the fitting projections 110 are tightly and resiliently fitted into and fixed to mounting recesses 121 as described above. In order to detachably fix the track projection 109 to the bobbin case holder body 102, an adhesive may be used.

The bobbin case holder body 102 may be made of, for example, stainless steel or steel. Alternatively, the bobbin case holder body 102 may be made of a complex of a synthetic resin and a metal. For example, the complex of a synthetic resin and a metal may be produced by charging fibers of a metal such as aluminum or brass into an epoxy resin. The thickness of the metal fibers is about 0.01 mm. This improves mechanical properties such as tensile strength and compressive strength. Specifically, when 35% of metal fibers are added, the tensile strength is increased about five times.

It is also preferable to use an epoxy injection molded resin in which aluminum powder or iron powder is charged into an epoxy resin. This improves mechanical strength.

In another embodiment of the embodiment, a complex of a synthetic resin and carbon powder may be used in place of the complex of a synthetic resin and a metal.

The track projection member 104 is made of high-density polyethylene containing, for example, grease which functions as a lubricant. The high-density polyethylene containing grease is produced by mixing synthetic resin powder of polyethylene with grease, heating the mixture to about 150° C., and solidifying it in a resinous form. The high-density polyethylene has a specific gravity of 0.94 to 0.96, a degree of crystallinity of 85 to 95%, and a hardness Hs of 75. The degree of separation of oil after being subjected to 5,700 G for one hour is 5%. The high-density polyethylene has a compressive strength of about 30 kgf/cm$^2$. The grease may be lithium soap grease having excellent heat resistance, or jelly-like silicone grease which is produced by mixing silica gel with methylsilicone oil. In the configuration in which the track projection 109 of the bobbin case holder 101 is made of such a resin, sliding contact between the track projection 109 and the track groove 113 causes the grease in the high-density polyethylene to ooze out to lubricate them.

In another embodiment of the invention, such a resin is used only in the surface layer of the track projection 109, and the portions of the track projection 109 other than the surface layer are made of a synthetic resin having another composition, etc.

The outer loop taker 112 may be made of steel, stainless steel, a synthetic resin, an inorganic material, or another material.

In a further embodiment of the invention, the track projection member 104 may be made of a liquid crystal polymer.

Even when a sewing operation is performed at a high speed and for a long period of time while using the outer loop taker 112 and the bobbin case holder 101 which comprise portions made of a liquid crystal polymer, abrasion wear of the surface of the track projection 109 is reduced to a very low level. Thereby, durability is improved remarkably.

In a further embodiment of the invention, the track projection member 104 is made of a material in which alumina powder is scattered in aluminum alloy powder. Such material has properties that wear resistance is high, reduction in strength is small even at an elevated temperature, and workability is excellent. The aluminum alloy powder may be manufactured by the following process. An aluminum alloy which is called A2000 series and contains steel, magnesium, nickel and iron is powdered, and 2 to 5% of alumina powder of a particle size of about 5 microns is added to the aluminum alloy powder to be mixed therewith. The mixture is subjected to press molding, and thereafter is subjected to hot-extrusion at 400° C. to form a rod-like billet. The thus obtained aluminum alloy billet is shaped into a prefixed shape by, for example, cold forging, and a finishing operation such as the polishing is conducted on the thus shaped product. The outer loop taker 112 and the bobbin case holder 101 may be made of such an aluminum alloy and be subjected to, for example, quenching and tempering operations after cold forging, and will have a wear resistance which is about 100 times that of carbon steel. Tensile strength is 36 $kgf/mm^2$ at 150° C., or equivalent to that of carbon steel at room temperature or five times that of pure aluminum.

Even when a sewing operation using the thus configured outer loop taker 112 and bobbin case holder 101 is performed at a high speed and for a long period of time, abrasion wear of the surface of the track groove 113 and track projection 109 is at a very low level, thereby remarkably improving durability.

The invention can be applied not only to a horizontal axis full rotary hook, and a vertical axis full rotary hook but also to a wide range of other structures including an oscillating loop taker, etc.

The bobbin case holder and outer loop taker may be made of the same material as that of the track projection.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and the range of equivalency of the claims are therefore intended to be embraced therein.

What is claimed is:

1. An inner bobbin case holder to be fitted in a rotatable outer loop taker of a full rotary hook, said inner bobbin case holder comprising:

a body having an outer circumference;

a track projection on said outer circumference of said body and extending circumferentially thereof between a loop spreading portion of said track projection and a thread releasing portion thereof; and said track projection comprising a portion made of metal and a coating member made of synthetic resin integrally fixed to and covering said metal portion, with a part of said metal portion at an upstream end thereof relative to a direction of rotation of the rotatable outer loop taker being uncovered and exposed from said coating member.

2. An inner bobbin case holder as claimed in claim 1, wherein said coating member is made of a liquid crystal polymer.

3. An inner bobbin case holder as claimed in claim 1, wherein said body is made of metal.

4. An inner bobbin case holder as claimed in claim 3, wherein said body and said metal portion of said track projection are formed integrally.

5. An inner bobbin case holder as claimed in claim 1, wherein said metal portion has formed therein a circumferential groove, and said coating member includes a portion fitted in said groove.

6. An inner bobbin case holder as claimed in claim 1, wherein said metal portion has formed therein two axially spaced grooves, and said coating member includes portions fitted into said grooves.

7. An inner bobbin case holder as claimed in claim 1, wherein said metal portion has formed therein circumferentially spaced holes, and said coating member has portions filling said holes.

8. An inner bobbin case holder as claimed in claim 1, wherein said metal portion has formed therein circumferentially spaced recesses, and said coating member has portions filling said recesses.

9. An inner bobbin case holder as claimed in claim 1, wherein said metal portion has circumferentially spaced projections extending into said coating member.

10. An inner bobbin case holder to be fitted in a rotatable outer loop taker of a full rotary hook, said inner bobbin case holder comprising:

a body having an outer circumference having formed therein a circumferential fitting groove and a plurality of circumferentially spaced recesses extending inwardly from said fitting groove;

a track projection member having an inner circumference having extending radially inwardly therefrom a plurality of circumferentially spaced fitting projections; and said track projection member being fitted into said fitting groove of said body with said fitting projections fitting into said fitting recesses and retaining said track projection member on said body.

11. An inner bobbin case holder as claimed in claim 10, wherein said track projection member and said fitting projections are formed integrally as a unitary, one-piece structure.

12. An inner bobbin case holder as claimed in claim 10, wherein said track projection member is formed of synthetic resin.

13. An inner bobbin case holder as claimed in claim 10, wherein said track projection member is formed of an inorganic material.

14. An inner bobbin case holder as claimed in claim 10, constructed to be employed in a horizontal axis full rotary hook or a vertical axis full rotary hook.

15. An inner bobbin case holder as claimed in claim 10, wherein at least a surface layer of said track projection member is made of high-density polyethylene including a lubricant.

16. An inner bobbin case holder as claimed in claim 10, wherein said track projection member is made of a liquid crystal polymer.

17. An inner bobbin case holder as claimed in claim 10, wherein said track projection member is made of a material including alumina powder scattered in aluminum alloy powder.

18. An inner bobbin case holder as claimed in claim 10, wherein said track projection member is made of a material including metal powder scattered in fluororesin.

* * * * *